US007651183B2

(12) United States Patent
Eade

(10) Patent No.: US 7,651,183 B2
(45) Date of Patent: Jan. 26, 2010

(54) IMAGING APPARATUS FOR FACILITATING PRINTING

(75) Inventor: Thomas Jon Eade, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 272 days.

(21) Appl. No.: 11/404,358

(22) Filed: Apr. 14, 2006

(65) Prior Publication Data

US 2006/0187244 A1 Aug. 24, 2006

Related U.S. Application Data

(62) Division of application No. 10/603,926, filed on Jun. 25, 2003, now Pat. No. 7,063,399.

(51) Int. Cl.
*B41J 29/38* (2006.01)

(52) U.S. Cl. ..... 347/5; 347/19

(58) Field of Classification Search ..... 347/2, 347/84–86, 7, 5, 19
See application file for complete search history.

(56) References Cited

U.S. PATENT DOCUMENTS

| | | | | |
|---|---|---|---|---|
| 3,961,337 | A | 6/1976 | Jung et al. | 346/140 |
| 4,342,042 | A | 7/1982 | Cruz-Uribe et al. | 346/140 |
| 4,538,896 | A | 9/1985 | Tajima et al. | 355/3 |
| 4,813,912 | A | 3/1989 | Chickneas et al. | 364/464.02 |
| 4,831,389 | A | 5/1989 | Chan | 346/140 |
| 4,929,963 | A | 5/1990 | Balazar | 346/1.1 |
| 5,115,275 | A | 5/1992 | Suzuki | 355/245 |
| 5,181,787 | A | 1/1993 | Hosomi | 400/120 |
| 5,184,177 | A | 2/1993 | Kikuchi et al. | 355/200 |
| 5,196,884 | A | 3/1993 | Sugiyama et al. | 355/200 |
| 5,367,328 | A | 11/1994 | Erickson | 347/7 |
| 5,416,395 | A | 5/1995 | Hiramatsu et al. | 318/600 |
| 5,737,670 | A | 4/1998 | Ikegawa | 399/149 |
| 5,742,883 | A | 4/1998 | Girard et al. | 399/262 |
| 5,757,390 | A | 5/1998 | Gragg et al. | 347/7 |
| 5,818,484 | A | 10/1998 | Lee et al. | 347/86 |
| 5,835,818 | A | 11/1998 | Hoshika et al. | 399/26 |
| 6,106,088 | A | 8/2000 | Wafler | 347/7 |
| 6,145,968 | A | 11/2000 | Fries et al. | 347/85 |
| 6,149,256 | A | 11/2000 | McIntyre et al. | 347/2 |
| 6,219,153 | B1 * | 4/2001 | Kawanabe et al. | 358/1.16 |
| 6,227,638 | B1 * | 5/2001 | Childers et al. | 347/7 |
| 6,231,148 | B1 | 5/2001 | Silverbrook | 347/2 |
| 6,287,028 | B1 | 9/2001 | Silverbrook | 400/88 |
| 6,295,423 | B1 | 9/2001 | Haines et al. | 399/24 |
| 6,385,421 | B1 | 5/2002 | Imamiya et al. | 399/237 |
| 6,412,993 | B1 | 7/2002 | Silverbrook | 400/621 |
| 6,454,482 | B1 | 9/2002 | Silverbrook et al. | 401/195 |
| 6,512,894 | B2 | 1/2003 | Takemoto et al. | 399/12 |
| 6,536,886 | B1 | 3/2003 | Mott | 347/85 |
| 6,779,875 | B2 * | 8/2004 | Pawlowski et al. | 347/50 |
| 6,798,995 | B2 * | 9/2004 | Nagata | 399/8 |

(Continued)

*Primary Examiner*—Thinh H Nguyen
(74) *Attorney, Agent, or Firm*—Taylor & Aust, PC

(57) ABSTRACT

An imaging apparatus includes a printing mechanism. A reservoir is connected to the printing mechanism. The reservoir contains an imaging substance supply. A secured compartment contains at least the reservoir, the secured compartment being configured to restrict access to the reservoir. A communication port is configured to receive print data. The communication port is communicatively coupled to the printing mechanism, and the communication port is accessible from outside the secured compartment.

14 Claims, 4 Drawing Sheets

U.S. PATENT DOCUMENTS 6,827,419 B2 12/2004 Buibas et al. ..... 347/19
7,013,101 B2 * 3/2006 Maruyama et al. ..... 399/109
7,331,051 B2 * 2/2008 Wong et al. ..... 719/327
2003/0170038 A1 9/2003 Ito et al. ..... 399/24
2003/0180058 A1 9/2003 Alegria et al. ..... 399/9

* cited by examiner

IMAGING APPARATUS FOR FACILITATING PRINTING

This is a divisional of application Ser. No. 10/603,926, filed Jun. 25, 2003, now U.S. Pat. No. 7,063,399 entitled IMAGING APPARATUS AND METHOD FOR FACILITATING PRINTING.

BACKGROUND OF THE INVENTION

1. Field of the Invention

The present invention relates to imaging, and, more particularly, to an imaging apparatus and method for facilitating printing.

2. Description of the Related Art

An imaging apparatus has associated therewith a reservoir, such as for example, an ink supply tank, an ink jet cartridge, a toner tank, or electrophotographic process (EP) cartridge, that stores a supply of an imaging substance, such as for example ink or toner, that is consumed during an imaging process. Examples of such an imaging apparatus include an ink jet printer and/or copier, or an electrophotographic printer and/or copier. During imaging with the imaging apparatus, the amount of the imaging substance is depleted. Thus, eventually, once the imaging substance supply of the imaging media is exhausted, the imaging media is either discarded or is re-filled. Over time, however, the imagining apparatus will experience wear by the continued use, thereby possibly adversely affecting print quality. In addition, over time the printer may become obsolete.

What is needed in the art is an apparatus and method of facilitating printing, wherein the imaging apparatus may be exchanged for a different imaging apparatus when the supply of imaging substance is depleted.

SUMMARY OF THE INVENTION

The present invention provides apparatus and method of facilitating printing, wherein the imaging apparatus may be exchanged for a different imaging apparatus when the supply of imaging substance is depleted.

The invention, in one form thereof, relates to a method for facilitating printing, including the steps of providing to a consumer a first printer containing a fixed amount of imaging substance; receiving back from the consumer the first printer after a substantial portion of the imaging substance has been used; and exchanging the first printer with an exchange printer.

In another form thereof, the invention relates to a printer including a printing mechanism. A reservoir is connected to the printing mechanism. The reservoir contains an imaging substance supply. A control unit contains a printer driver for the printing mechanism. The control unit is configured to perform the steps of sensing a connection to a computer; and uploading the printer driver from the controller to the computer after sensing the connection to the computer.

In another form thereof, the invention relates to an imaging apparatus including a printing mechanism. A reservoir is connected to the printing mechanism. The reservoir contains an imaging substance supply. A secured compartment contains at least the reservoir. The secured compartment is configured to restrict access to the reservoir. A communication port is configured to receive print data. The communication port is communicatively coupled to the printing mechanism. The communication port is accessible from outside the secured compartment.

In still another form thereof, the invention relates to a method for facilitating imaging, including the steps of providing to a consumer a first recyclable imaging apparatus having a secured compartment containing a reservoir containing an initial amount of imaging substance, the secured compartment restricting access to the reservoir, the initial amount of imaging substance including a licensed amount of imaging substance and a surplus amount of imaging substance; and receiving from the consumer a request for license renewal, wherein upon a grant of the request for license renewal the surplus amount of imaging substance is available for use in the imaging apparatus.

An advantage of the present invention, in some embodiments, is that printer set up and use can be accomplished with little or no interaction with the end user.

Another advantage, in some embodiments, is that cost reductions can be achieved by elimination of hardware components required to accommodate replaceable imaging components, e.g., elimination of printhead alignment hardware and firmware in the case where the printhead is fixed to the carrier.

In embodiments including the secured compartment, costs savings may be realized through elimination of an access door.

In embodiments designed to address a specific printing task, e.g., a single use, such as printing on A4 media in a single printing mode, e.g., a draft mode, cost savings can be realized through the selection of electrical and hardware components specifically sized for the specific printing task.

BRIEF DESCRIPTION OF THE DRAWINGS

The above-mentioned and other features and advantages of this invention, and the manner of attaining them, will become more apparent and the invention will be better understood by reference to the following description of exemplary embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
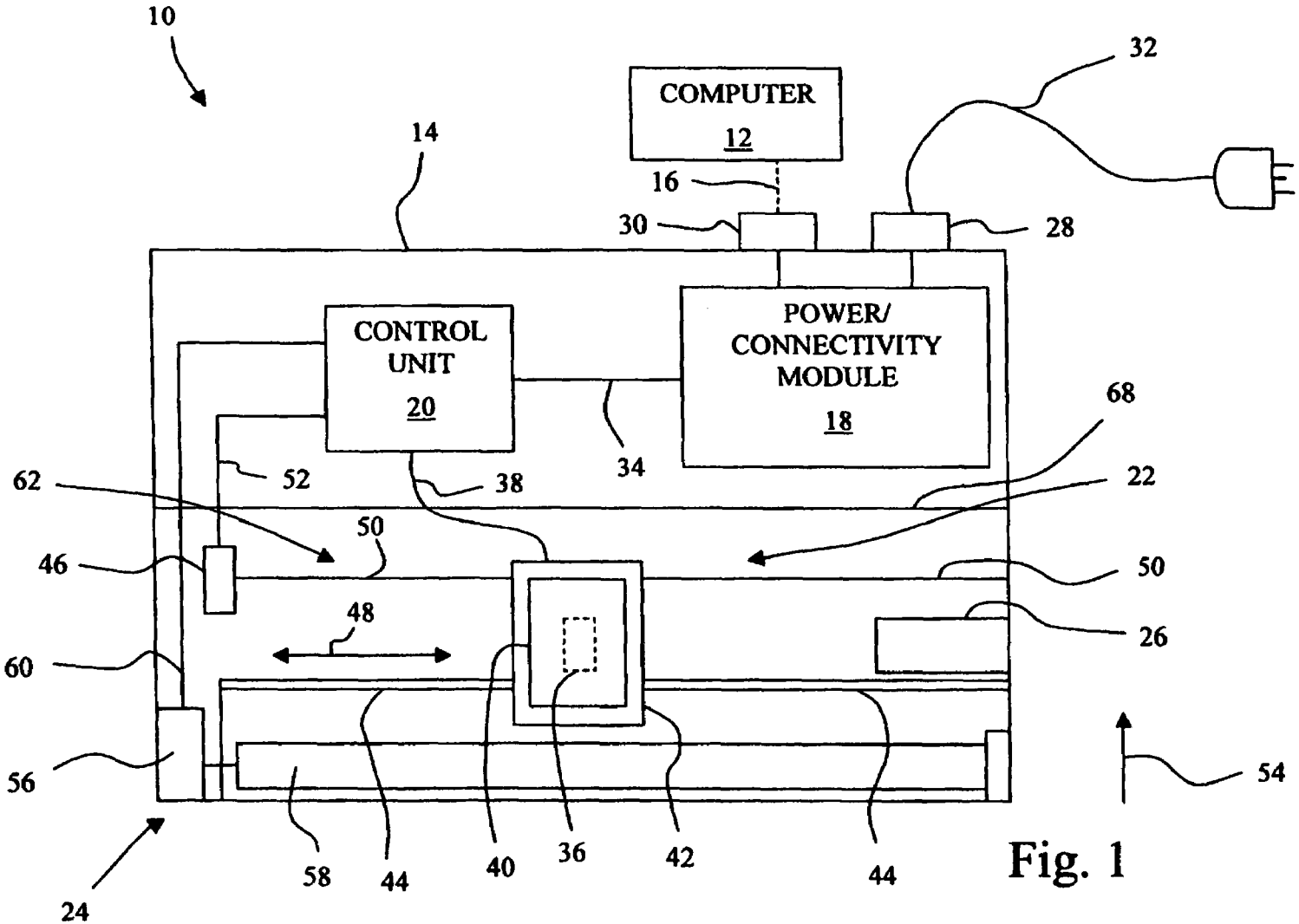
FIG. 1 is a diagrammatic representation of an imaging system employing an embodiment of the present invention.

Referring now to the drawings and particularly to FIG. 1, there is shown an imaging system 10 employing an embodiment of the present invention. Imaging system 10 includes a computer 12 and an imaging apparatus in the form of an ink jet printer 14. Computer 12 is communicatively coupled to ink jet printer 14 by way of communications link 16. Communications link 16 may be, for example, a wired connection, such as a USB connection; a wireless connection, such as an optical connection, e.g., an infrared connection, an r.f. connection, or a standard wireless protocol, e.g., Bluetooth; or a network connection, such as an Ethernet Local Area Network.

Computer 12 is typical of that known in the art, and may include a monitor to display graphics or text, an input device such as a keyboard and/or mouse, a microprocessor and associated memory, such as random access memory (RAM), read only memory (ROM) and a mass storage device, such as CD-ROM or DVD hardware.

Ink jet printer 14 includes a power/connectivity module 18, a control unit 20, a printing mechanism 22, a media feed unit 24, a maintenance station 26.

Power/connectivity module 18 includes appropriate electrical hardware, such as a transformer, rectifier and voltage regulator, to provide electrical power at the proper voltage and polarity for use by printer 14. Also, power/connectivity module 18 includes appropriate electrical hardware/firmware to facilitate communications with an external device, such as computer 12.

Power/connectivity module 18 includes a power port 28 and a communications port 30. Power port 28 is configured for connection to an AC power cord 32 for supplying electrical power to printer 14. Alternatively, power port 28 and power/connectivity module 18 may be modified to facilitate a battery power supply, or an adaptor for connection to an external DC power source. Communications port 30 may be configured to connect to appropriate wired communications cabling, such as for example, a universal serial bus (USB). Alternatively, communications port 30 may be configured to receive wireless communication. Further, communications port 30 is communicatively coupled to printing mechanism 22 via control unit 20, and is configured to receive print data from computer 12 and/or an intervening device, and supply the print data for use by printing mechanism 22.

Control unit 20 is connected to power/connectivity module 18 via a communications link 34, such as for example, a combination power and data bus. Controller 20 may be an application specific integrated circuit (ASIC), including a processing unit, firmware and associated memory. Upon application of power to printer 14, control unit 20 exercises an initialization routine, including detecting whether communications link 16 is communicatively connected to an external device, such as computer 12. If control unit 20 determines that communications port 30 is communicatively connected to computer 12, then printer driver software stored in control unit 20 and/or power connectivity module 18 is uploaded from printer 14 to the memory of computer 12. Such an upload may occur without user intervention, if desired. The printer driver software places print data and print commands supplied by the external device, e.g., computer 12, in a format that can be recognized by ink jet printer 14.

At a minimum, printing mechanism 22 will include a device for printing an imaging substance onto a print media, such as paper, transparency, etc. For example, where printing mechanism 22 is an ink jet mechanism, at a minimum, printing mechanism 22 will include a printhead 36. Printhead 36 is communicatively coupled to control unit 20 via a communications link 38. Printhead 36 is fluidly connected to a reservoir 40 containing an imaging substance, such as ink. Printhead 36 may, for example, be a monochrome printhead, a color printhead, or may represent multiple printheads, e.g., both a monochrome printhead and a color printhead. Reservoir 40 may include, for example, monochrome ink, color ink, or both monochrome ink and color ink. Alternatively, printhead 36 may be integrated with reservoir 40 to form a unitary ink jet printhead cartridge.

Further, in the embodiment shown in FIG. 1, however, printing mechanism 22 may include a printhead carrier 42, a guide member 44 for guiding printhead carrier 42, and a carrier drive 46. Carrier drive 46 effects reciprocating motion of printhead carrier 42 along guide member 44 in a bi-directional scanning direction 48. Guide member 44 may include one or more guide rods and/or a guide tab formed integral with the frame of printer 14.

Printhead carrier 42 carries, e.g., has mounted thereto, one or more printheads, such as a printhead 36. As shown, reservoir 40 is located on-carrier. Alternatively, reservoir 40 may be located off-carrier, and coupled to a respective printhead or printheads via respective fluid conduits. In some embodiments printhead 36 is fixed to printhead carrier 42.

Carrier drive 46 includes a motor, such as a D.C. motor or a stepper motor, and an associated drive train. Carrier drive 46 is connected via a carrier belt 50 to printhead carrier 42 so as to convey printhead carrier 42 along guide member 44 in bi-directional scanning path 48. Alternatively, carrier drive 46 may be connected to printhead carrier 42 via other push-pull devices, such as for example, a worm gear train. Carrier drive 46 is electrically connected to control unit 20 via a communications link 52, such as, for example, a multi-wire a cable.

Media feed unit 24 is used to convey print media sheets past printhead 36 in a media feed direction 54. Media feed unit 24 includes a media feed drive 56 and one or more driven rollers, such as a feed roller 58.

Media feed drive 56 includes a motor, such as a D.C. motor or a stepper motor, and an associated drive train. Media feed drive 56 is connected via a gear train and/or belt configuration to feed roller 58, and any other driven rollers, such as an exit roller (not shown). Media feed drive 56 is electrically connected to control unit 20 via a communications link 60, such as for example, a multi-wire cable.

At a directive of control unit 20, printhead carrier 42 is transported in a controlled manner along bi-directional scanning path 48 defined by guide member 44, via carrier drive 46 and carrier belt 50. During printing, control unit 20 controls the movement of printhead carrier 42 so as to cause printhead carrier 42 to move in a controlled reciprocating manner, back and forth along guide member 44. Control unit 20 supplies electrical address and control signals to the ink jetting actuators of printhead 36 to effect the selective ejection of ink from printhead 36. The sheet of print media is transported by the rotation of feed roller 58 at the directive of control unit 20, via media feed drive 56. During each printing scan of printhead carrier 42, the sheet of print media is held stationary by feed roller 58.

Maintenance station 26 is provided for performing printhead maintenance operations on the ink jet nozzles of printhead 36. Such operations include, for example, a printhead spit maintenance operation, a printhead wiping operation and a printhead maintenance capping operation. Other services, such as for example, printhead priming and suction, may also be performed if desired by the inclusion of a vacuum device (not shown) of the type well known in the art. However, in cost reduced versions of the present invention, maintenance station 26 will be made as simple as possible, and may include only a respective wiper and cap.

Printer 14 further includes a secured compartment 62 that contains at least reservoir 40, and in the embodiment shown in FIG. 1, further contains printing mechanism 22, including printhead 36. In another embodiment, it is contemplated that all internal components of printer 14 are contained in secured compartment 62. Secured compartment 62 is configured to restrict access to the components contained therein, such as for example, reservoir 40 and printing mechanism 22. Such access is restricted to authorized personnel.

Figure 2:
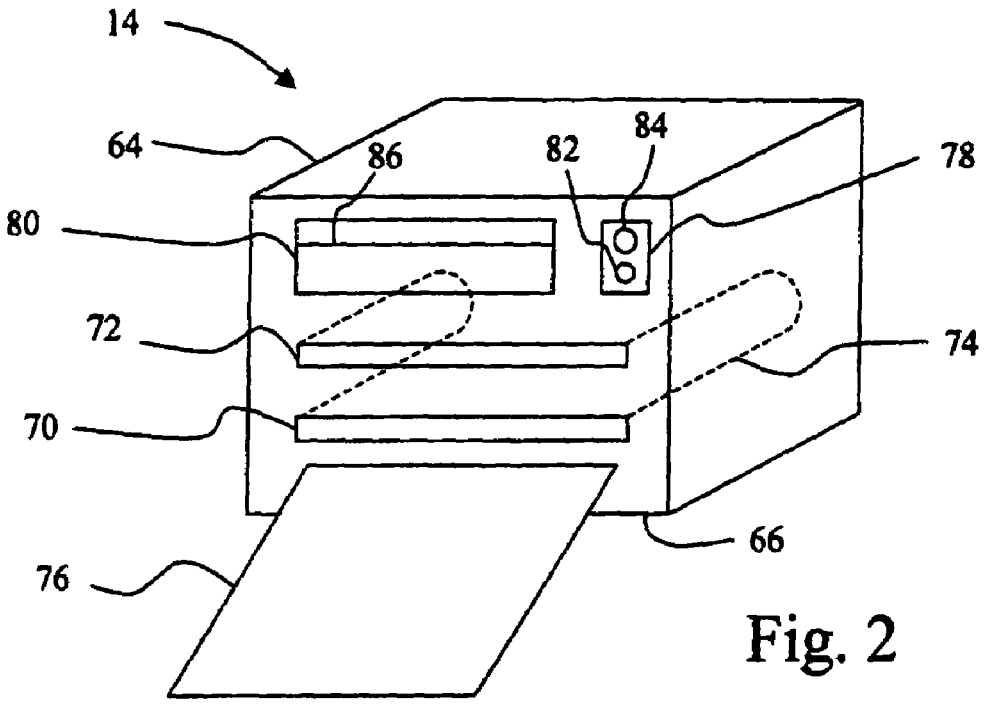
FIG. 2 is a diagrammatic perspective view of one embodiment of the imaging apparatus of FIG. 1.
Figure 3:
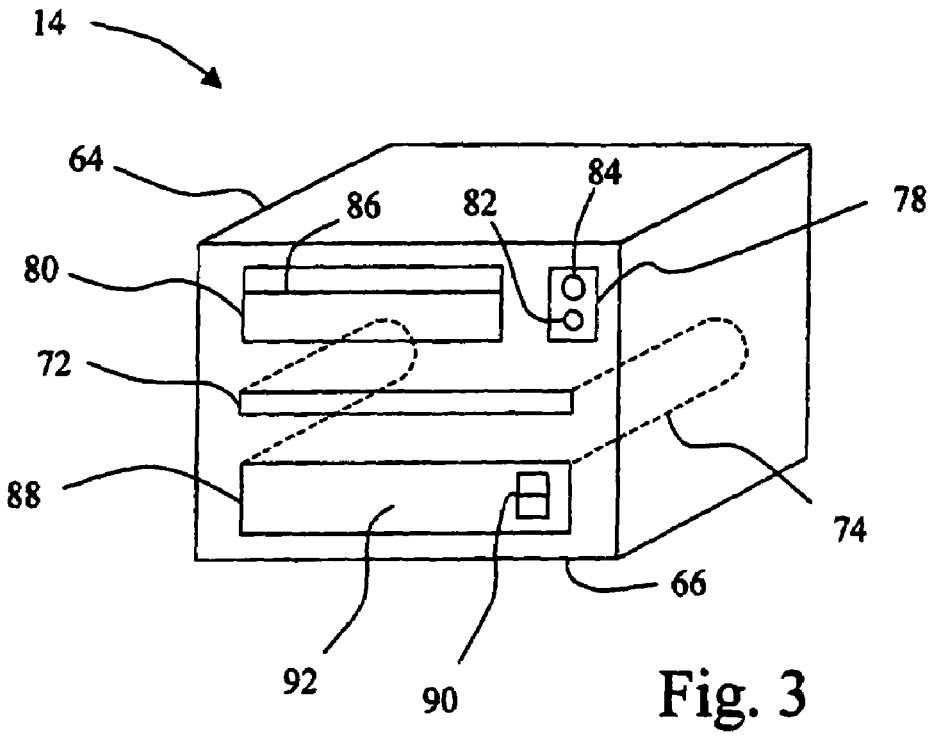
FIG. 3 is a diagrammatic perspective view of another embodiment of the imaging apparatus of FIG. 1.

Referring also to FIGS. 2 and 3, secured compartment 62 may be defined by the attachment of a printer cover 64 to a printer base 66, such that, for example, printer cover 64 is not readily separable from printer base 66 without the use of specialized and/or proprietary tools, or extraordinary measures, e.g., cutting and/or destroying printer cover 64 and/or printer base 66. Accordingly, printer cover 64 may be affixed by an adhesive, plastic melt, weld, solder or appropriate secure fasteners to printer base 66. Thus, in effect, secured compartment 62 is sealed by the manufacturer. As a further alternative, a secured compartment 62 may be formed as a separate compartment within printer 14 by arranging an enclosure by one or more internal walls 68. Communications port 30, however, is communicatively accessible from outside secured compartment 62.

In embodiments where printhead 36 also is contained in secured compartment 62, limited access ports are provided to facilitate the supply of the print media sheet to printhead 36. However, such limited access ports would not facilitate access to reservoir 40.

Referring now to FIG. 2, there is shown an embodiment of printer 14, wherein printer cover 64 includes a media feed port 70 and a media output port 72. A media path, such as a C-shaped media path 74, connects media feed port 70 and media output port 72. For example, a sheet of print media 76 may be inserted into media feed port 70, which in turn is transported by transport rollers, e.g., feed roller 58, along C-shaped media path 74 for printing by printhead 36, and the printed sheet 76 is delivered to the user via media output port 72.

Printer 14 also includes a user interface 78 and a display cover 80. User interface 78 may include a printer reset button 82 and a printer status indicator lamp 84. However, if the reset and indication functionality are incorporated into the uploaded printer driver, it may be possible to further cost reduce printer 14 by the elimination of user interface 78. Display cover 80 is made of a clear plastic, and includes a slot 86 for inserting an information sheet, such as an advertisement, printing instructions, retailer logo, etc., for display to a user or potential customer.

Referring now to FIG. 3, there is shown an embodiment of printer 14, differing from that of FIG. 2 only in that the media feed port 70 of FIG. 2 is replaced by a media tray 88, wherein media tray 88 holds a predetermined amount of print media sheets, such as print media sheets 76. Media tray 88 may be fixed to printer 14 and may be included in secured compartment 62, wherein media tray 88 includes only one media type and size. Alternatively, media tray may be configured to be user removable from printer 14, and may be configured to accommodate only one media type and size, or alternatively, may be configured to accommodate multiple media types and/or sizes.

Also, as shown in FIG. 3, printer 14 may include a media level gauge 90 for providing a visual indication of the amount of print media contained in media tray 88. Media level gauge 90 may be, for example, a clear window formed in the outer panel 92 of media tray 88.

Figure 4:
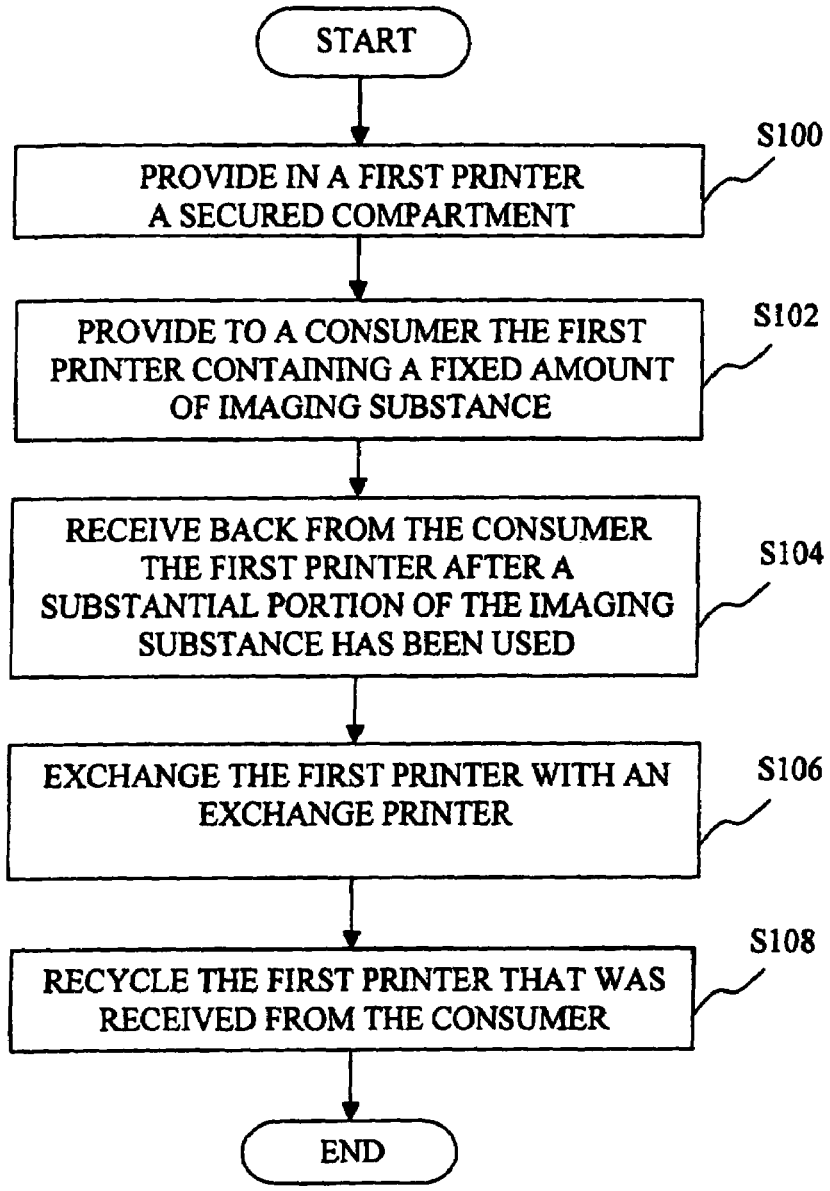
FIG. 4 is a flowchart of a method for facilitating printing in accordance with the present invention.

FIG. 4 is a flowchart of a method for facilitating printing in accordance with the present invention.

At step S100, a first printer. e.g., printer 14, is provide with secured compartment 62. Secured compartment 62 includes, at a minimum, reservoir 40, and in addition may include other components, such as for example, printing mechanism 22. In other words, the first printer 14 is configured to restrict the access to reservoir 40 to authorized personnel.

In addition, for example, first printer 14 may be configured and controlled to operate only in a single printing mode and/or to use only a single print media type and/or size.

At step S102, a consumer is provided with the first printer 14, which contains a fixed amount of imaging substance, such as for example, ink. The fixed amount of imaging substance is contained in reservoir 40. During the consumer's use of printer 14, print data is communicated to printing mechanism 22, which in turn forms an image on the sheet of print media 76. As such, imaging substance is depleted from reservoir 40.

At step S104, the first printer 14 is received back from the consumer after a substantial portion of the imaging substance has been used. A substantial portion may be, for example, 80 percent of the initial amount of imaging substance, or more. Most likely, however, step S104 will occur after the user has extracted as much imaging substance as possible from 14, and a reduction of print coverage is experienced.

At step S106, the first printer 14 is exchanged with an exchange printer, such as another printer like printer 14. The exchange may be facilitated, for example, at a retail outlet.

At step S108, the first printer received from the consumer is recycled. Such recycling will include at least a replenishing of the imaging substance supply in reservoir 40, and may include replacement or repair of other components, such as printing mechanism 22.

Figure 5:
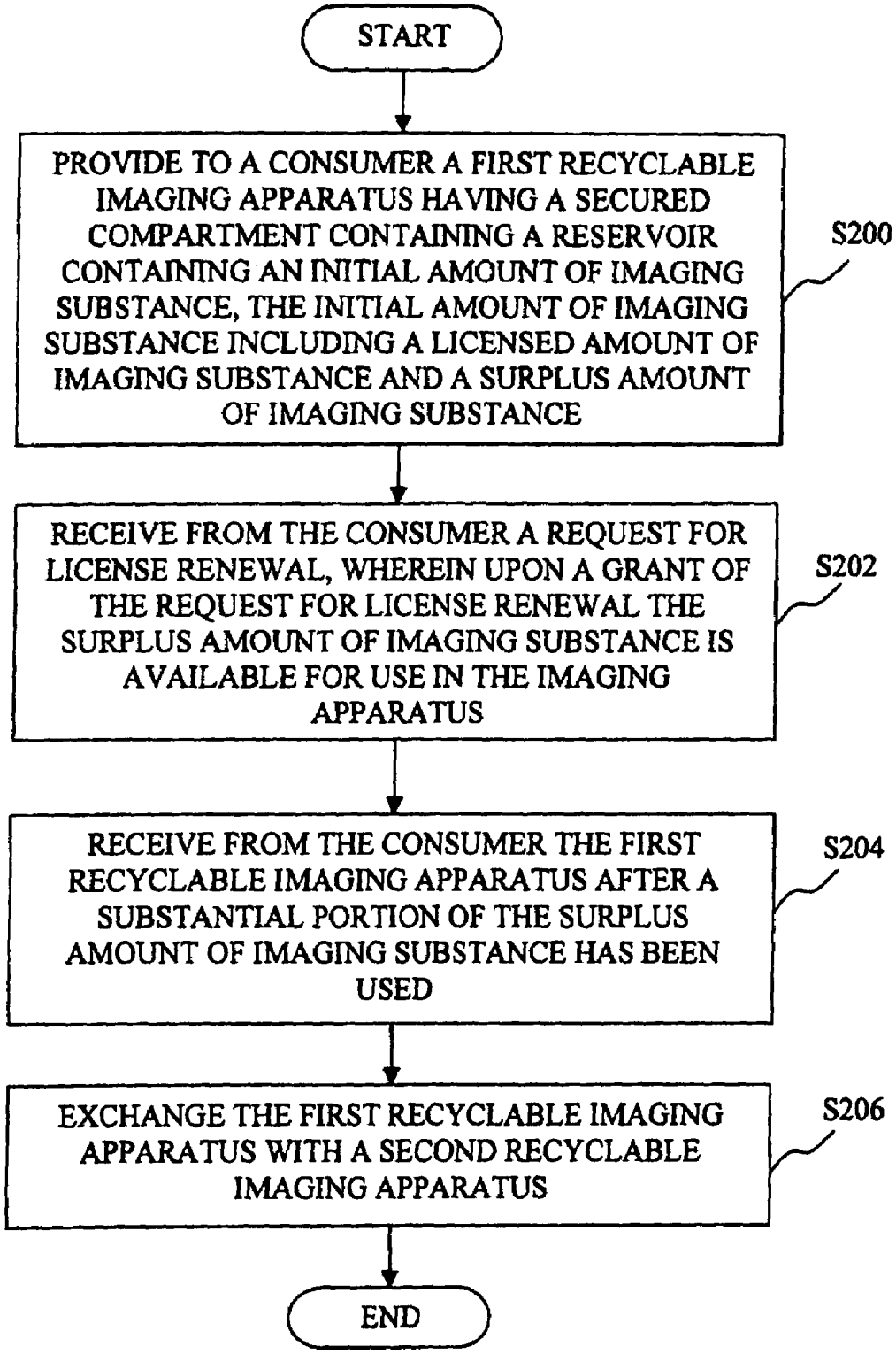
FIG. 5 is a flowchart of another method for facilitating imaging in accordance with the present invention.

FIG. 5 is a flowchart of a method for facilitating imaging in accordance with the present invention.

At step S200, a consumer is provided with a first recyclable imaging apparatus, such as printer 14, having a secured compartment 62 containing a reservoir 40 containing an initial amount of imaging substance. Secured compartment 62 restricts access to reservoir 40. The initial amount of imaging substance includes a licensed amount of imaging substance and a surplus amount of imaging substance.

At step S202, received from the consumer is a request for license renewal, wherein upon a grant of the request for license renewal the surplus amount of imaging substance is available for use in the imaging apparatus. The consumer's request may be facilitated, for example, via an Internet access to an e-commerce database, via a telephone request, or via a retail outlet, wherein an authorization number is provided and input via the printer driver to the first recyclable imaging apparatus.

At step S204, received from the consumer is the first recyclable imaging apparatus, e.g., printer 14, after a substantial portion of the surplus amount of imaging substance has been used. A substantial portion may be, for example, 80 percent of the surplus amount of imaging substance, or more.

At step S206, the first recyclable imaging apparatus is exchanged with a second recyclable imaging apparatus. The second recyclable imaging apparatus may be, for example, a printer like printer 14. The exchange may be facilitated, for example, at a retail outlet.

The recycling of the first recyclable imaging apparatus will include at least a replenishing of the imaging substance supply in reservoir 40, and may include replacement or repair of other components, such as printing mechanism 22.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A printer, comprising:

a printing mechanism;

a reservoir connected to said printing mechanism, said reservoir containing an imaging substance supply, wherein the reservoir is enclosed within a secured compartment such that the reservoir is only accessible to an authorized user; and a control unit containing a printer driver for said printing mechanism, said control unit being configured to perform the steps of:

sensing a connection to a computer; and uploading said printer driver from said control unit to said computer after sensing said connection to said computer.

2. The printer of claim 1, wherein said control unit performs said uploading automatically without operator intervention.

3. The printer of claim 1, wherein the secured compartment further includes said printing mechanism, said secured compartment being configured to permanently restrict access to said printing mechanism by a user.

4. The printer of claim 3, wherein said printer is recycled when a substantial amount of said imaging substance supply contained in said reservoir is exhausted.

5. The printer of claim 1, further comprising a clear display cover having a slot for receiving an information sheet.

6. The printer of claim 5, wherein said information sheet includes a retailer logo.

7. An imaging apparatus, comprising:

a printing mechanism;

a reservoir connected to said printing mechanism, said reservoir containing an imaging substance supply;

a secured compartment containing at least said reservoir, said secured compartment being configured to allow access to said reservoir only to authorized personnel; and a communication port configured to receive print data, said communication port being communicatively coupled to said printing mechanism, and said communication port being accessible from outside said secured compartment, wherein said secured compartment is sealed by a manufacturer of said imaging apparatus.

8. The imaging apparatus of claim 7, wherein said secured compartment includes a print media port for receiving a sheet of print media.

9. The imaging apparatus of claim 7, wherein said secured compartment includes a media port for receiving a print media tray.

10. The imaging apparatus of claim 7, wherein said secured compartment further contains said printing mechanism, said secured compartment being configured to restrict access to said printing mechanism.

11. The imaging apparatus of claim 10, wherein said printing mechanism comprises:

a reciprocating printhead carrier; and a printhead fixed to said reciprocating printhead carrier.

12. The imaging apparatus of claim 7, wherein said printing mechanism comprises:

a reciprocating printhead carrier; and an ink jet printhead fixed to said reciprocating printhead carrier.

13. The imaging apparatus of claim 7, further comprising a clear display cover having a slot for receiving an information sheet.

14. The imaging apparatus of claim 13, wherein said information sheet includes a retailer logo.

* * * * *

UNITED STATES PATENT AND TRADEMARK OFFICE

CERTIFICATE OF CORRECTION

PATENT NO. : 7,651,183 B2
APPLICATION NO. : 11/404358
DATED : January 26, 2010
INVENTOR(S) : Thomas Jon Eade It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 559 days.

Signed and Sealed this

Twenty-eighth Day of December, 2010

David J. Kappos

David J. Kappos
*Director of the United States Patent and Trademark Office*